US005946341A

United States Patent [19]

Bizzarri

[11] Patent Number: 5,946,341

[45] Date of Patent: Aug. 31, 1999

[54] METHOD PERTAINING TO THE OPERATION OF ELECTRIC FURNACES, AND A FURNACE

[75] Inventor: Venanzio Bizzarri, Hallstahammar, Sweden

[73] Assignee: Kanthal AB, Hallstahammar, Sweden

[21] Appl. No.: 08/675,929

[22] Filed: Jul. 5, 1996

[30] Foreign Application Priority Data

Jul. 6, 1995 [SE] Sweden ..... 9502475

[51] Int. Cl.[6] ..... H05B 3/62

[52] U.S. Cl. ..... 373/118; 373/109; 373/133

[58] Field of Search ..... 373/109, 110, 373/111, 118, 119, 132, 133, 57–59

[56] References Cited

U.S. PATENT DOCUMENTS 3,128,325 4/1964 Andersen et al. ..... 373/109

5,544,195 8/1996 Hardt et al. ..... 373/115

*Primary Examiner*—Tu Ba Hoang

*Attorney, Agent, or Firm*—Alfred J. Mangels

[57] ABSTRACT

An electrically heated furnace includes an inner furnace chamber provided with heating elements of stabilized zirconium dioxide, and an outer furnace chamber in which further heating elements that can work at temperatures above 1800° C. in an oxygen-containing atmosphere are provided. The outer heating elements are conveniently of a molybdenum silicide type, for instance elements marketed under the designation KANTHAL Super. Those walls that define the inner furnace chamber are made of zirconium dioxide material or some other suitable material that has a low specific thermal conductivity and that is capable of withstanding the high working temperature and the occurrent temperature swings. The outer furnace chamber, which completely surrounds the inner furnace chamber, is separated from the surroundings by conventional walls insulated, e.g., with ceramic fibres and/or high-temperature durable brick.

23 Claims, 3 Drawing Sheets

METHOD PERTAINING TO THE OPERATION OF ELECTRIC FURNACES, AND A FURNACE

BACKGROUND OF THE INVENTION

FIELD OF THE INVENTION

The present invention relates to a method pertaining to the operation of high-temperature electric furnaces. The invention also relates to a furnace of this kind.

More specifically, the present invention relates to a furnace for very high operating temperatures, viz, temperatures in the range of 1800–2000° C. and higher, and also to a method of operating such furnaces. Temperatures in excess of 1800° C. are achieved with the aid of electric resistor elements, for instance resistor elements comprised of stabilized zirconium dioxide.

Resistor elements for electric furnaces are made of different materials. Metallic materials can be used for temperatures up to about 1400° C. It is possible to use elements of molybdenum disilicide for temperatures up to about 1850° C. For temperatures higher than these temperatures, the elements may be made of graphite, stabilized zirconium dioxide and other materials. When used in oxidizing atmospheres, the resistors may be made solely of oxidic material, such as stabilized zirconium dioxide, for instance.

Neither stabilized zirconium dioxide nor resistor elements based on stabilized zirconium dioxide are electrically conductive at room temperature. The material, however, becomes conductive at higher temperatures, and marked current strengths are obtained through a zirconium dioxide element in the temperature range of 700–1000° C. The conductor resistance of the material thereafter falls with rising temperatures. The material thus has a negative temperature coefficient. Consequently, in order to be able to use zirconium dioxide resistor elements in electrically heated furnaces, it is necessary to pre-heat the elements so that they are able to reach a temperature at which they are sufficiently electrically conductive to begin to work. Hitherto, this pre-heating of the elements has been achieved by using metallic resistor elements in different furnace constructions.

In furnace constructions for working temperatures above 1800° C., ceramic material based on stabilized zirconium dioxide is also used for the walls, floor and ceiling of the furnace since it is found that this material is able to withstand these high temperatures better than other materials. Furnace constructions that include zirconium dioxide elements thus comprise an inner furnace chamber which is delimited by walls, floor and ceiling comprised of stabilized zirconium dioxide material. One or more resistor elements of stabilized zirconium dioxide are mounted in the inner furnace chamber. The inner walls are surrounded by an external insulation, preferably a ceramic fiber insulation. Metallic resistor elements, e.g. elements made of an iron-chromium-aluminium alloy, are embedded in this insulation at a sufficient distance from the inner furnace chamber. It is also known to arrange the latter resistor elements in an outer furnace chamber which is insulated from the surroundings. The aforesaid outer elements are used to pre-heat the furnace to a temperature at which the zirconium dioxide elements can begin to work. Because the maximum temperature to which the metallic elements can be subjected is considerably lower than the working temperature in the inner furnace chamber, the thickness of the insulation must be such as to ensure that the maximum temperature capable of being withstood by the metallic elements will not be exceeded.

This results in high thermic inertia of the furnace and consequently very long pre-heating and cooling times. It is also necessary to halt the supply of energy to the metallic elements when the furnace is in operation, in order to prevent overheating of said elements.

The zirconium dioxide elements are produced in the form of straight rods or tubes. The elements have a hot zone in the center thereof and are provided at each outer end with a wire lead-in having a cross-sectional area which is larger than the hot zone. Both the hot zone and lead-ins are preferably comprised of yttrium stabilized zirconium dioxide, mutually of the same composition. To enable the transfer of energy from an external source of electric current to the elements, platinum wires are wound around the lead-ins at a suitable distance from the hot zone, and passed out through openings in the furnace chamber.

Because of the high working temperature, the supply of energy to the elements cannot be controlled in a usual manner with a temperature sensor mounted in the furnace. One method of regulating the furnace is to control the power supplied as a function of time on the basis of values obtained with experience. This method does not provide any absolute control over the temperature in the furnace chamber and results in a high degree of uncertainty, among other things because the properties of the elements vary with time.

The object of the present invention is to enable the use of zirconium dioxide elements in a manner which lengthens the useful life of said elements and of the platinum windings on the lead-ins. Another object of the invention is to enable the working temperature in the furnace chamber to be controlled and adjusted more accurately. Still another object of the invention is to provide a furnace construction which affords shorter start-up times and more rapid heating, and also more rapid cooling.

SUMMARY OF THE INVENTION

The present invention thus relates to a method of operating an electrically heated furnace having an inner chamber provided with inner resistor elements of stabilized zirconium dioxide, and an outer chamber having outer resistor elements made of another material. The outer chamber wall that is proximal to the surroundings has a higher thermal conductivity than the outer chamber wall that is proximal to the inner chamber of said furnace. For the purpose of maintaining a predetermined operating temperature in the inner chamber of the furnace, the resistor elements in the outer furnace chamber are supplied with power sufficient to maintain a requisite temperature in the outer furnace chamber at a predetermined power input to the resistor elements in the inner furnace chamber, and therewith maintain a heat balance between the inner chamber, the outer chamber and the surroundings.

The invention also relates to a furnace of the aforesaid kind having an inner furnace chamber with inner resistor elements of stabilized zirconium dioxide and an outer furnace chamber having outer resistor elements of another material. The outer chamber wall that is proximal to the surroundings has a higher thermal conductivity than the outer chamber wall that is proximal to the inner furnace chamber. A control device functions to activate the resistor elements in the outer chamber at a predetermined power input to the resistor elements in the inner chamber such that the outer chamber resistor elements are supplied with sufficient power to maintain a required temperature in the outer furnace chamber, thereby to maintain a predetermined operating temperature in the inner chamber, and to maintain a heat balance between the inner chamber, the outer chamber, and the surroundings.

BRIEF DESCRIPTION OF THE DRAWINGS

The invention will now be described in more detail, partly with reference to an exemplified embodiment of the invention, and also with reference to the accompanying drawings, in which.

DESCRIPTION OF THE PREFERRED EMBODIMENTS

Figure 1:
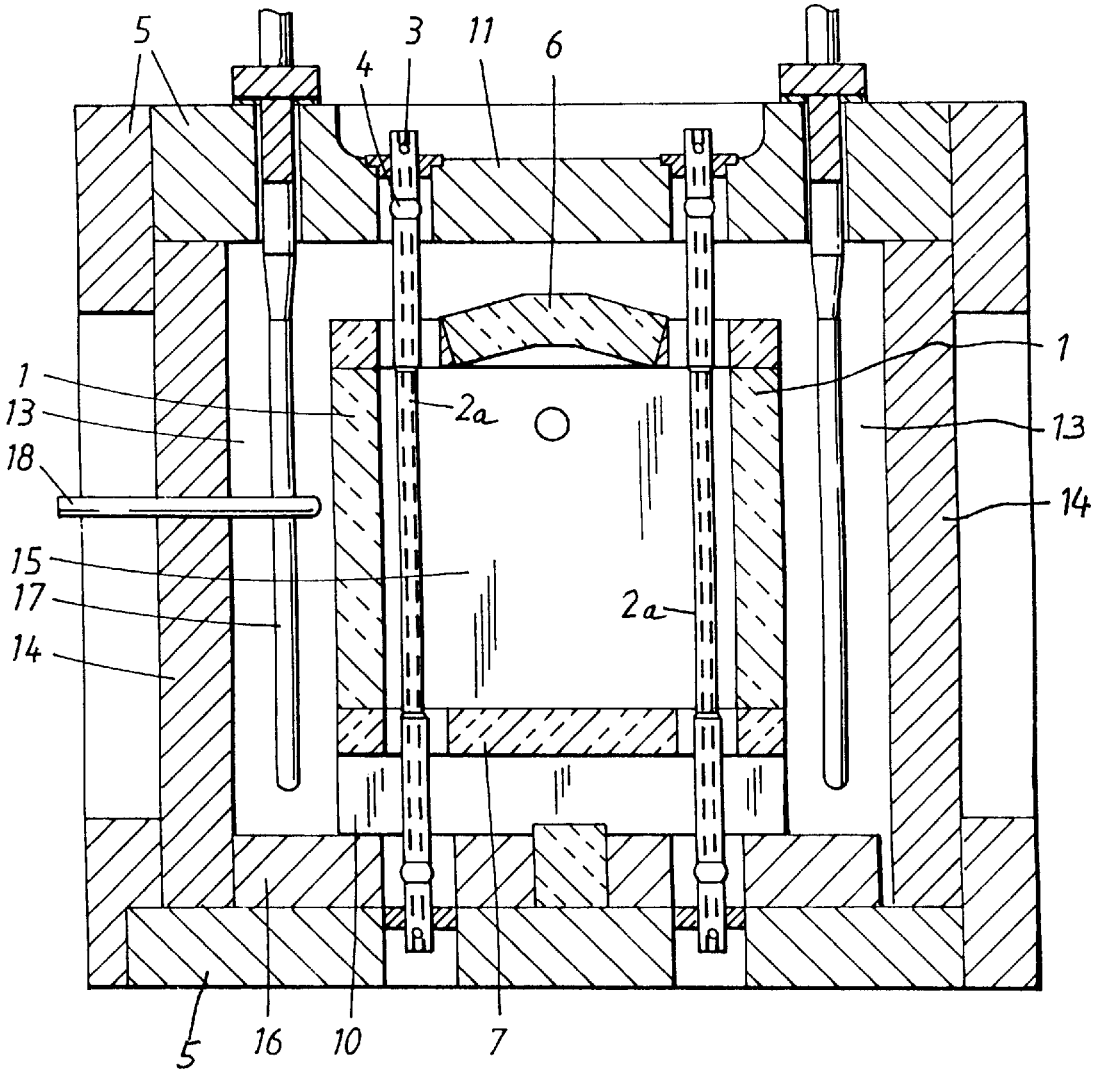
FIG. 1 is a vertical cross-sectional view of an inventive furnace as seen from the front.

An electrically heated inventive furnace includes an inner furnace chamber provided with resistor elements made of stabilized zirconium dioxide, and an outer furnace chamber provided with further resistor elements which can operate at temperatures of up to 1800° C. in an oxygen-containing atmosphere. The outer resistor elements are suitably of a molybdenum disilicide type, for instance resistor elements marketed under the designation KANTHAL Super. The walls, ceiling and floor defining the inner chamber are comprised of stabilized zirconium dioxide material or some other appropriate ceramic material, such as a material chosen from the group hafnium dioxide, thorium dioxide or yttrium oxide or other oxides or oxide combinations that have low thermal conductivity and are able to withstand the aforesaid high temperature and occurrent temperature changes. A typical value with regard to the thermal conductivity of stabilized zirconium dioxide at 1650° C. is 0.144 W/m ° K. The outer furnace chamber completely surrounds the inner furnace chamber and is delimited to the surroundings by high-grade fiber ceramic material on the front and the rear side of said furnace chamber. Externally of the inner furnace chamber is a chamber in which the molybdenum disilicide elements are placed. The outer side walls of this outer furnace chamber are made of a material that has a considerably higher thermal conductivity than stabilized zirconium dioxide, such as aluminium oxide brick, for instance. The outer resistor elements are freely mounted in the furnace chamber, i.e. are not embedded in the insulating material. The outer elements will preferably have a length such that radiation emitted thereby will directly reach parts of the lead-in conductors of the zirconium dioxide elements. The outer elements are of a conventional kind and include a U-shaped hot zone and lead-in conductors which are made from the same material as the hot zone but are larger or coarser than said zone. The outer side walls of the outer furnace chamber, made of aluminium oxide, are freely radiating on the outside so as to permit sufficiently effective heat emission from the molybdenum silicide elements, such that said elements will remain activated during a full working cycle. The temperature is controlled with the aid of a PtRh 6/30-type thermocouple in the outer chamber for regulating the supply of energy to the outer resistor elements, and with optical temperature control in the inner chamber, for regulating or controlling the supply of energy to the zirconium dioxide elements.

According to one preferred embodiment of the invention, the thermal conductivity of the outer furnace chamber wall that faces or lies proximal to the surroundings will preferably be so high in comparison with the thermal conductivity of the outer furnace chamber wall that faces towards or lies distal to the inner furnace chamber that when a predetermined operating temperature prevails in the inner furnace chamber, the resistor elements in the outer furnace chamber will be operated with at least 10% of maximum power, so as to maintain a predetermined temperature in the outer furnace chamber.

According to another preferred embodiment, which may exist simultaneously with the aforesaid embodiment, there is maintained in the outer furnace chamber a temperature which is at least 50%, preferably 75%, of the temperature in the inner furnace chamber measured in degrees Celsius, at a predetermined operating temperature in the inner furnace chamber.

Figure 2:
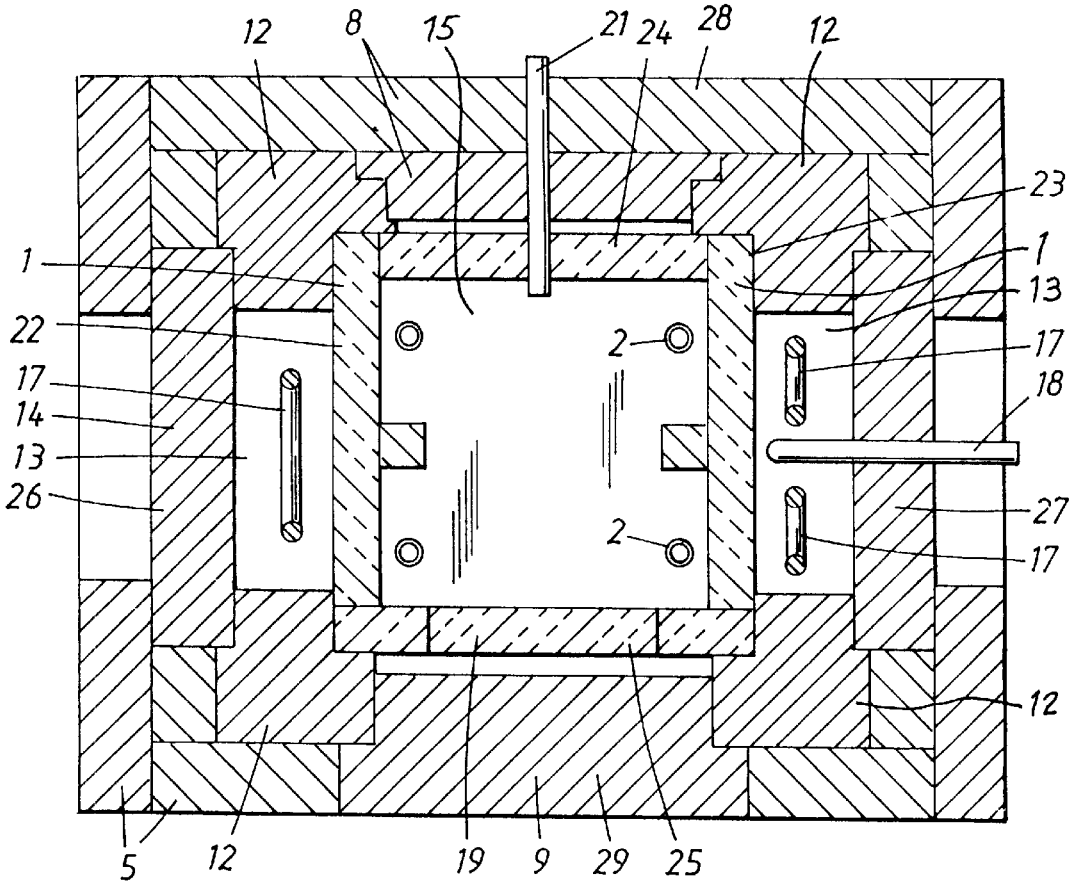
FIG. 2 is a horizontal cross-sectional view of an inventive furnace as seen from above.

The furnace illustrated in FIGS. 1 and 2 has an inner furnace chamber 15 and an outer furnace chamber 13. The inner furnace chamber is delimited by a ceiling 6, a bottom 7 and side walls 1. The side walls, ceiling and bottom are suitably made of ceramic material, preferably stabilized zirconium dioxide. The inner furnace chamber rests on beams 10 made of zirconium dioxide material. The inner furnace chamber 15 is supported at each of the four corners by aluminium-oxide corner pillars 12. The ceiling and bottom of the inner furnace chamber are provided with holes through which lead-ins 3 pass to respective inner zirconium dioxide heating elements 2*a*, whose hot zones 2 are located in the inner furnace chamber. The lead-ins 3 are made of the same material as the hot zones 2, i.e. of yttrium oxide stabilized zirconium dioxide. Electrical energy is supplied through lead-ins 4 comprised of platinum/rhodium wires. The wires are wound round the lead-ins 3 at the position where said lead-ins pass through the ceiling of the outer furnace chamber, and the platinum wires extend therefrom out of the furnace. The outer furnace chamber is delimited by a ceiling 11, which has a self-supporting construction, a bottom or floor 16, and walls 14. According to one preferred embodiment of the invention, the walls that delimit the outer furnace chamber from the surroundings are made of the materials aluminum oxide brick and aluminum oxide fiber material.

The outer furnace chamber 13 has provided therein resistor elements 17 which are preferably comprised of molybdenum disilicide material. The lead-ins to these elements extend out through the ceiling 11 of the outer furnace chamber. The elements are typically U-shaped.

Arranged in the outer furnace chamber 13 is a thermocouple 18 for sensing the temperature in the outer furnace chamber. The temperature of the outer furnace chamber is controlled with the aid of this thermocouple. The temperature in the inner furnace chamber 15 is controlled with the aid of an optical pyrometer 21 which measures the temperature with the aid of fiber optics.

According to one preferred embodiment in which the temperature of the outer furnace chamber is measured with the aid of a thermocouple, the temperature of the inner furnace chamber 15 is measured with the aid of a pyrometer 21 connected to the inner furnace chamber 15 by means of a fiber-optic cable.

It is preferred that the temperature in the outer furnace chamber 13 is measured at a point located between the outer resistor elements 17 and the wall 1 of the inner furnace chamber 15.

The furnace is provided with an outer insulation 5 of fiber material. The furnace opening includes an outer door 9 and an inner door 19. The illustrated and described furnace is a box-type furnace. Moving of the furnace opening to the bottom of the furnace makes the construction suitable for an elevator furnace.

It will be understood, however, that the present invention is not restricted to any particular type of furnace and that it can be applied to all types of furnaces.

According to one highly preferred embodiment of the invention, at least a part 27 of the outer furnace chamber walls 14, that lies proximal to the surroundings has a thermal conductivity which is higher than the thermal conductivity of the remainder of said walls. Resistor elements 17 are provided at least at and inwardly of said part 27 of the wall of said outer furnace chamber 13.

According to one highly preferred embodiment of the invention, in which the aforesaid embodiment is applied and also the method of operating said high temperature furnace, the outer resistor elements 17 are provided at two first opposing sides 22, 23 of the walls of the inner furnace chamber 15, while the two remaining, second opposing sides 24, 25 of the walls of the inner furnace chamber 15 are devoid of outer resistor elements. The walls of the outer furnace chamber 13 facing the surroundings are constructed so that the thermal conductivity of the two opposing walls 26, 27 of the outer furnace chamber 13 that are placed externally of said first sides 22, 23 of the inner furnace chamber 15 will be higher than the thermal conductivity of the two opposing walls 28, 29 of the outer furnace chamber 13 that are placed externally of said second sides 24, 25 of the inner furnace chamber 15.

Consequently, in the locations where the outer resistor elements 17 are placed, the thermal conductivity of the outer walls 26, 27 will be higher than the thermal conductivity of the two remaining walls 28, 29. As a result, there is obtained a "wall" at the first opposing sides 1 of the inner furnace chamber 15 which includes the outer furnace chamber 13 and its outer walls 14, 27 whose "insulating capacity" against the inner furnace chamber 15 can be regulated or controlled by means of the temperature in the outer furnace chamber 13, this temperature being regulated or controlled by the supply of energy to the outer resistor elements 17. By permitting considerable heat transport through those parts of the outer walls 14, 27 of the outer furnace chamber 13 where the resistor elements 17 are placed, it is feasible to say that the insulating capacity of said walls can be controlled electrically by the supply of energy to the resistor elements 17. That which is regulated or controlled in actual fact is the temperature on the outside of the adjacent walls of the inner furnace chamber 15, which in turn controls the temperature gradient and therewith the transportation of heat through the walls 1 of the inner furnace chamber 15.

One advantage afforded by the described and illustrated furnace construction is that a uniform and effective temperature control is achieved on the outtake parts of the zirconium dioxide heating elements 2*a* and the platinum wire connections thereto, via the communicating spaces of the outer furnace chamber 13 above and beneath the inner furnace chamber 15. This also means that the temperature will be smoothly controlled and without shocks or surges, therewith contributing towards improving the useful life span of the components in the furnace construction.

A furnace construction of the aforedescribed kind also enables the use of zirconium dioxide heating elements 2*a* of much larger dimensions than is possible in the earlier known furnace constructions. This affords additional advantages in the form of considerably improved mechanical properties.

Because the aforesaid insulating capacity can be regulated by the power applied to the outer resistor elements 17, the furnace can be cooled much more quickly than known furnaces of this kind.

Because the mass of the insulation of the outer furnace chamber 15 to the surroundings is low in comparison with known furnaces, the start-up time is also shorter than in the case of these known furnaces.

According to one preferred embodiment, the supply of energy to the inner heating elements 2*a* is regulated and controlled by measuring the temperature in the inner furnace chamber 15. Similarly, the supply of energy to the outer resistor elements 17 is regulated or controlled by measuring the temperature in the outer furnace chamber 13.

According to one preferred embodiment of the invention, as illustrated below, the supply of energy to the inner and the outer resistor elements 2*a*, 17, respectively is regulated in accordance with the prevailing temperature in both the inner furnace chamber 15 and the outer furnace chamber 13, at least time-wise. A control device which functions to this end is described below.

Figure 3:
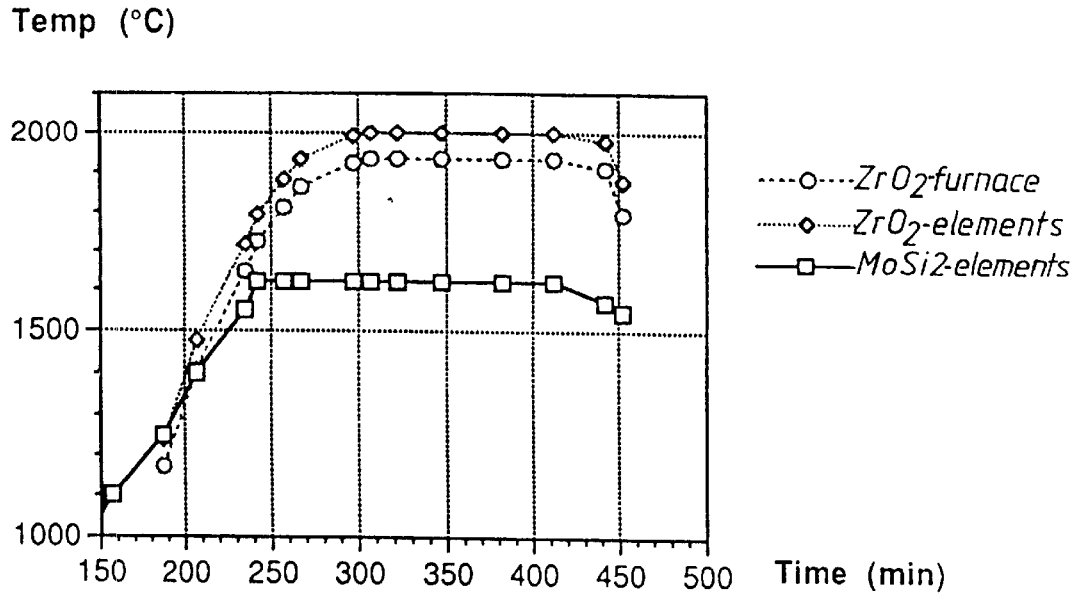
FIG. 3 is a graph of temperature as a function of time during a working cycle.

FIG. 3 illustrates the course followed by the temperature during a working cycle of a furnace according to FIG. 1, and for zirconium dioxide heating elements 2*a* and molybdenum disilicide elements 17 in the furnace. One important advantage afforded by an inventive furnace is that part of the energy is supplied during the whole of the working cycle with the aid of resistor elements in the outer furnace chamber 13. Thus, these elements are not switched-off when the furnace reaches its working temperature, as in the case of earlier known furnace constructions of this kind. The outer furnace chamber 13 is also heated to high temperatures, although not higher than to prevent the use of a conventional thermocouple for sensing the temperature in said chamber, and also not higher than the temperature that has been preset for this chamber. This presumes that the material in the wall of the inner furnace chamber 15 will have very low thermal conductivity, wherewith stabilized zirconium dioxide is a suitable material also for this reason. The energy delivered by the outer resistor elements 17 is regulated with the aid of the sensed temperature.

The temperature in the inner and the outer furnace 15, 13, respectively, chambers is controlled with the aid of a respective control instrument, each of which is provided with an individual program. The supply of energy to the inner elements 17 is controlled and regulated with the aid of an optical sensor 21 which measures the temperature in the inner furnace chamber with the aid of fiber optics. The supply of energy to the outer furnace chamber 13 is controlled and regulated with the aid of a thermocouple 18. Each of the two sensors 21, 18 is connected to a respective conventional control instrument. The temperature control instruments are connected to one another in a manner such as to enable said instruments to send signals to one another at given pre-programmed temperatures.

The furnace is preferably controlled so that energy is supplied to the outer resistor elements 17 when starting-up the furnace and so that energy is also supplied to the inner heating elements 2*a* when the inner furnace chamber 15 has been heated to a predetermined temperature. When the temperature in both furnace chambers has reached approximately the same level during the heating process, the energy supplied to the outer heating elements 17 is lowered to a level which is less than half of the earlier power input.

However, the inner heating elements 2*a* can be supplied with energy right from the very beginning.

Figure 4:
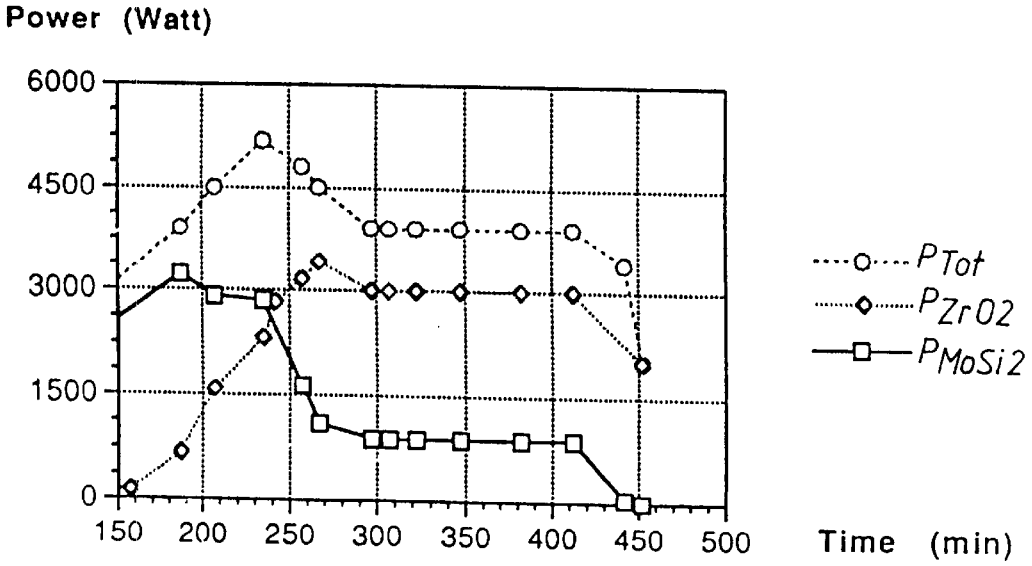
FIG. 4 is a graph that shows the development of power as a function of time in the furnace shown in FIGS. 1 and 2.

FIG. 4 shows the power development in a furnace according to FIG. 1, both totally and for the inner and the outer heating elements 2*a*, 17 individually. The power development has been plotted as a function of time during a working cycle. The total power supplied to the furnace comprises the sum of the power delivered to the outer and the inner heating elements 2*a*, 17. The power development in the inner heating elements 2*a* is shown in the diagram by a line $P_{ZrO2}$. The power development in these elements does not begin until a temperature of 700–1000° C. is reached, prior to which the material has no marked electrical conductivity. The power development then rises continuously up to the working temperature obtained, whereafter the power development is held constant. The heating elements 17 in the outer furnace chamber 13 show a rising power development, particularly during the first part of the starting-up period. The power development in the outer heating elements 17 reduces markedly before or after reaching working temperature in the inner furnace chamber 15, due to the heat delivered through the walls 1 of the inner furnace chamber to the outer furnace chamber 13, and reaches a state of equilibrium at a value of about 25% of the power development in the inner heating elements 2*a*. This is shown by the line marked $P_{Mosi2}$. The total power developed in the furnace is shown by the line $P_{Tot}$. Energy is thus supplied during the whole of the working cycle, also from the outer heating elements 17. The energy required to maintain or sustain the temperature in the outer furnace chamber 13 is obtained both from the molybdenum silicide outside heating elements 17 and from the energy transported through the walls of the inner furnace chamber 15 of the furnace. This total amount of energy shall balance the energy that is lost through the outer aluminium-oxide walls 26, 27 of the outer chamber furnace 15, 13, so as to maintain the outer chamber of said furnace at the preprogrammed temperature. This contributes towards maintaining a high and well-controlled temperature in the inner furnace chamber 15 of the furnace. Upon completion of the heat treatment process, a signal is sent from the temperature control equipment of the inner furnace chamber 15 to the temperature control equipment of the outer chamber, therewith breaking off the supply of energy to the outer heating elements 17 . The temperature of the inner heating elements 2*a* is also lowered at the same time in accordance with a given program and the power developed in the inner heating elements 2*a* decreases.

The temperature can rise extremely quickly when starting-up the furnace, for instance at a rate of 7° per minute. This is considerably quicker than in the case of the known furnace constructions described in the introduction, in which pre-heating is effected with metallic elements, and it also gives a shorter working cycle than said known constructions.

Figure 5:
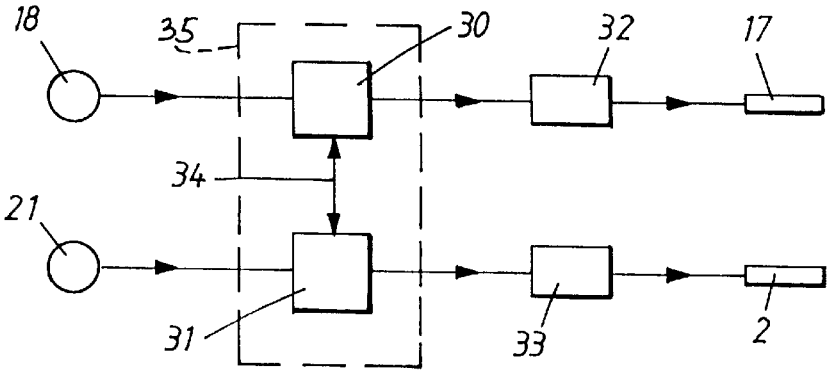
FIG. 5 illustrates schematically control means.

The regulating or control means will now be briefly described with reference to FIG. 5.

The regulator means may include two different regulating devices, one for the outer furnace chamber 13 and one for the inner furnace chamber 15 of said furnace. Each regulating device includes a control circuit 30, 31 of some suitable known kind. Each control circuit is adapted to detect a real value from respective sensors in the form of said thermocouple 18 or said pyrometer 21. Each control circuit includes a microprocessor or the like programmed to cause the control circuit to activate a power regulating means 32, 33 in accordance with the temperature prevailing in the outer furnace chamber 13 and/or the inner furnace chamber 15 of the furnace. The power regulating devices 32, 33 will suitably comprise thyristors or corresponding devices. The power regulating devices control the power delivered to the heating elements 2*a*, 17.

When the two control circuits 30, 31 are intended to activate respective heating elements in accordance with the temperature in both of said furnace chambers, a signal line 34 is provided between the control circuits 30, 31.

As will be understood, the two described control circuits 30, 31 can be integrated to form a single control circuit, as indicated by the broken line 35 in FIG. 3.

Although the invention has been described in the with reference to a number of exemplifying embodiments thereof, it will be obvious that variations can be made. For instance, the furnace geometry may be different to that illustrated, and one or more of the furnace walls may be made from other materials having corresponding mechanical strength and thermal properties.

The present invention is thus not restricted to the aforesaid exemplifying embodiments thereof, since variations and modifications can be made within the scope of the following claims.

What is claimed is:

1. A method of operating an electrically heated furnace having an inner chamber defined by an inner chamber wall and including inner resistor elements of stabilized zirconium dioxide, and having an outer chamber defined by an outer chamber wall and including outer resistor elements of a different material, said method comprising the steps of: providing an outer chamber wall having a higher thermal conductivity than the thermal conductivity of the inner chamber wall of said furnace; supplying the inner resistor elements with electrical power at a predetermined power input; and supplying the outer resistor elements with electrical power sufficient to maintain a predetermined temperature in the outer furnace chamber at the predetermined power input to the inner resistor elements to maintain a predetermined operating temperature in the inner chamber and therewith maintain a heat balance between the inner chamber, the outer chamber and areas external to the outer chamber.

2. A method according to claim 1, wherein at least a part of the outer chamber wall has a thermal conductivity which is higher than the thermal conductivity of the remainder of said outer wall; and positioning the outer resistor elements at least at and inwardly of said higher thermal conductivity part of the outer chamber wall.

3. A method according to claim 1, wherein the thermal conductivity of the outer chamber wall is high in comparison with the thermal conductivity of the inner chamber wall, and including the step of maintaining a predetermined operating temperature in the inner chamber by operating the outer resistor elements with at least 10% of maximum power in maintaining a predetermined temperature in the outer chamber.

4. A method according to claim 1, including the step of maintaining a predetermined operating temperature in the inner chamber by maintaining in the outer chamber a temperature which is at least about 50% of the temperature in the inner chamber, measured in degrees Celsius.

5. A method according to claim 1, including the steps of measuring the temperature of the outer chamber with a thermocouple, and measuring the temperature of the inner chamber with a pyrometer connected to the inner chamber with a fibreoptic cable.

6. A method according to claim 1, including the steps of locating the outer resistor elements at two first opposing sides of the inner chamber walls; maintaining two remaining, second, opposing sides of the inner chamber walls devoid of outer resistor elements; and selecting the thermal conductivity of the outer chamber walls such that the thermal conductivity of opposing outer chamber walls that are outside said first sides of the inner chamber wall is higher than the thermal conductivity of opposing outer chamber walls that are outside said second sides of the inner chamber wall.

7. A method according to claim 1, including the step of controlling and regulating the supply of energy to the inner resistor elements as a function of the temperature in the inner chamber.

8. A method according to claim 1, including the step of controlling and regulating the supply of energy to the outer resistor elements as a function of the temperature in the outer chamber.

9. A method according to claim 8, including the step of measuring the temperature in the outer chamber at a point between the outer resistor elements and the inner chamber wall.

10. A method according to claim 1, including the step of controlling the supply of energy to the inner and the outer resistor elements in accordance with the temperature in both the inner and the outer chambers.

11. A method according to claim 10, including the steps of: delivering energy to the outer resistor elements when starting-up the furnace; delivering energy to the inner resistor elements when a predetermined temperature has been reached in the inner chamber; and reducing the supply of energy to the outer elements to a level corresponding to less than half the earlier supplied power when the temperature in the two furnace chambers has reached approximately the same temperature level during the heating process.

12. An electric furnace comprising:

an inner furnace chamber defined by an inner chamber wall, inner resistor elements of stabilized zirconium dioxide positioned within the inner furnace chamber, an outer furnace chamber adjacent to and outward of the inner furnace chamber, said outer furnace chamber defined by an outer chamber wall and having outer resistor elements of a material different from zirconium dioxide positioned between the outer chamber wall and the inner chamber wall, wherein the outer chamber wall has a higher thermal conductivity than the inner chamber wall; a control circuit for activating the outer resistor elements at a predetermined power input to the inner resistor elements, such that said outer resistor elements are supplied with sufficient power to maintain a requisite temperature in the outer furnace chamber and thereby to maintain a predetermined operating temperature in the inner furnace chamber, so that a heat balance is obtained between the inner furnace chamber, the outer furnace chamber and areas external to the outer chamber.

13. An electric furnace according to claim 12, wherein at least a part of the outer chamber wall has a higher thermal conductivity than the thermal conductivity of the remainder of said outer wall; and wherein the outer resistor elements are positioned inwardly of and adjacent to said higher thermal conductivity part of said outer chamber wall.

14. An electric furnace according to claim 12, including control means for supplying the outer resistor elements with at least 10% of maximum power at a predetermined operating temperature in the inner furnace chamber.

15. An electric furnace according to claim 14, wherein at a predetermined operating temperature in the inner furnace chamber, said control means functions to maintain in the outer furnace chamber a temperature which is at least about 50% of the temperature in the inner furnace chamber, measured in degrees Celsius.

16. An electric furnace according to claim 12, including a thermocouple for measuring the temperature in the outer furnace chamber, and a pyrometer for measuring the temperature of the inner furnace chamber, wherein the pyrometer is connected to the inner furnace chamber by a fibreoptic cable.

17. An electric furnace according to claim 12, wherein said outer resistor elements are positioned adjacent two first opposing sides of the inner chamber walls and two remaining, second, opposing sides of the inner chamber walls are spaced from said resistor elements; wherein a pair of outer chamber walls adjacent to said first inner chamber sides have a thermal conductivity that is higher than the thermal conductivity of two opposing outer chamber walls that are outwardly of and adjacent to said second inner chamber sides.

18. An electric furnace according to claim 12, wherein the outer resistor elements include molybdenum disilicide.

19. An electric furnace according to claim 12, wherein the inner chamber walls are made from materials selected from the group consisting of stabilized zirconium dioxide, hafnium dioxide, thorium dioxide, yttrium oxide, and mixtures thereof.

20. An electric furnace according to claim 12, wherein the outer chamber walls are made from materials selected from the group consisting of aluminum oxide brick and aluminum oxide fiber.

21. An electric furnace according to claim 14, wherein said control means functions to control the supply of energy to the inner and the outer resistor elements in dependence on the temperature prevailing in both the inner and the outer furnace chambers.

22. A method according to claim 1, including the step of maintaining a predetermined operating temperature in the inner chamber by maintaining in the outer chamber a temperature which is at least about 75% of the temperature in the inner chamber, measured in degrees Celsius.

23. An electric furnace according to claim 14, wherein at a predetermined operating temperature in the inner furnace chamber, said control means functions to maintain in the outer furnace chamber a temperature which is at least about 75% of the temperature in the inner furnace chamber, measured in degrees Celsius.

* * * * *